United States Patent [19]

Ahlgren

[11] 4,189,859

[45] Feb. 26, 1980

[54] DEVICE AT DISPLAY ARRANGEMENT

[75] Inventor: Stig B. Ahlgren, Malmo, Sweden

[73] Assignee: Prisma Neon AB, Malmo, Sweden

[21] Appl. No.: 822,714

[22] Filed: Aug. 8, 1977

[30] Foreign Application Priority Data

Aug. 9, 1976 [SE] Sweden ..... 7608882

[51] Int. Cl.[2] ..... G09F 11/02

[52] U.S. Cl. ..... 40/505

[58] Field of Search ..... 40/505, 473, 493, 503, 40/504

[56] References Cited

U.S. PATENT DOCUMENTS

| | | | |
|---|---|---|---|
| 3,199,239 | 8/1965 | Reed | 40/505 |
| 3,304,638 | 2/1967 | Grandell et al. | 40/505 |
| 3,696,536 | 10/1972 | Reese et al. | 40/505 X |
| 3,798,811 | 3/1974 | Rockola | 40/505 |

*Primary Examiner*—John F. Pitrelli

*Attorney, Agent, or Firm*—Friedman, Goodman & Teitelbaum

[57] ABSTRACT

A display having a frame and prisms rotatably mounted therein, each of the prisms including adjacent longitudinally extending side surfaces so that each set of associated side surfaces of the prisms provides a display when rotated to a side by side position defining a permanently recurring sequence with the number of displays corresponding to the number of side surfaces on each prism. Each prism is provided with a pair of rotation axles disposed at opposite ends thereof. A drive motor and a transmission rotate the prisms synchronously, the drive motor being connected to one of the rotation axles. Gear discs are mounted on one rotation axle of each pair provided on the prisms with at least one belt mounted on the gear discs for rotating the gear discs and the prisms when the one rotation axle is driven by the drive motor, the belt being toothed for meshing with the gear discs.

4 Claims, 2 Drawing Figures

DEVICE AT DISPLAY ARRANGEMENT

This invention relates to a device at a display arrangement comprising prisms, which are each mounted at opposite ends and rotary with equal sequence in a frame to the side of each other, the sides of the prisms in a permanently recurring sequence forming a number of displays corresponding to the number of side surfaces of a single prism, and including a drive motor for synchronous rotation of the prisms via a transmission.

Displays of the aforesaid kind usually comprise triangular aluminium prisms, which rotate in a aluminium frame and within 15 seconds show three displays in a permanently recurring sequence. The prisms can be dismounted and exchanged. Due to the triangular shape of the prisms, three different views can be shown. The display arrangement can be mounted with its frame standing free, on walls or on roofs of buildings.

Known display arrangements of the aforedescribed kind are driven by an electric motor, and the prisms are rotated synchronously via a gear transmission in such a manner, that the sides of respective prisms belonging to the same picture are shown simultaneously and form a display. The gear transmission ensures synchronous rotation of each prism. Gear transmission, however, involves certain disadvantages. One requirement at display arrangements is that they operate noiselessly, particularly when the displays are mounted on buildings. A gear transmission for operating noiselessly requires good lubrication, which is difficult to attend to at display arrangements, because this would require periodical service for lubrication, and display arrangements in most cases are positioned in places of difficult access. In order to improve the drive of the prisms so as to be noiseless without lubrication and simultaneously to maintain the synchronous drive of the prisms, the invention has been given the characterizing features as defined below.

Figure 1:
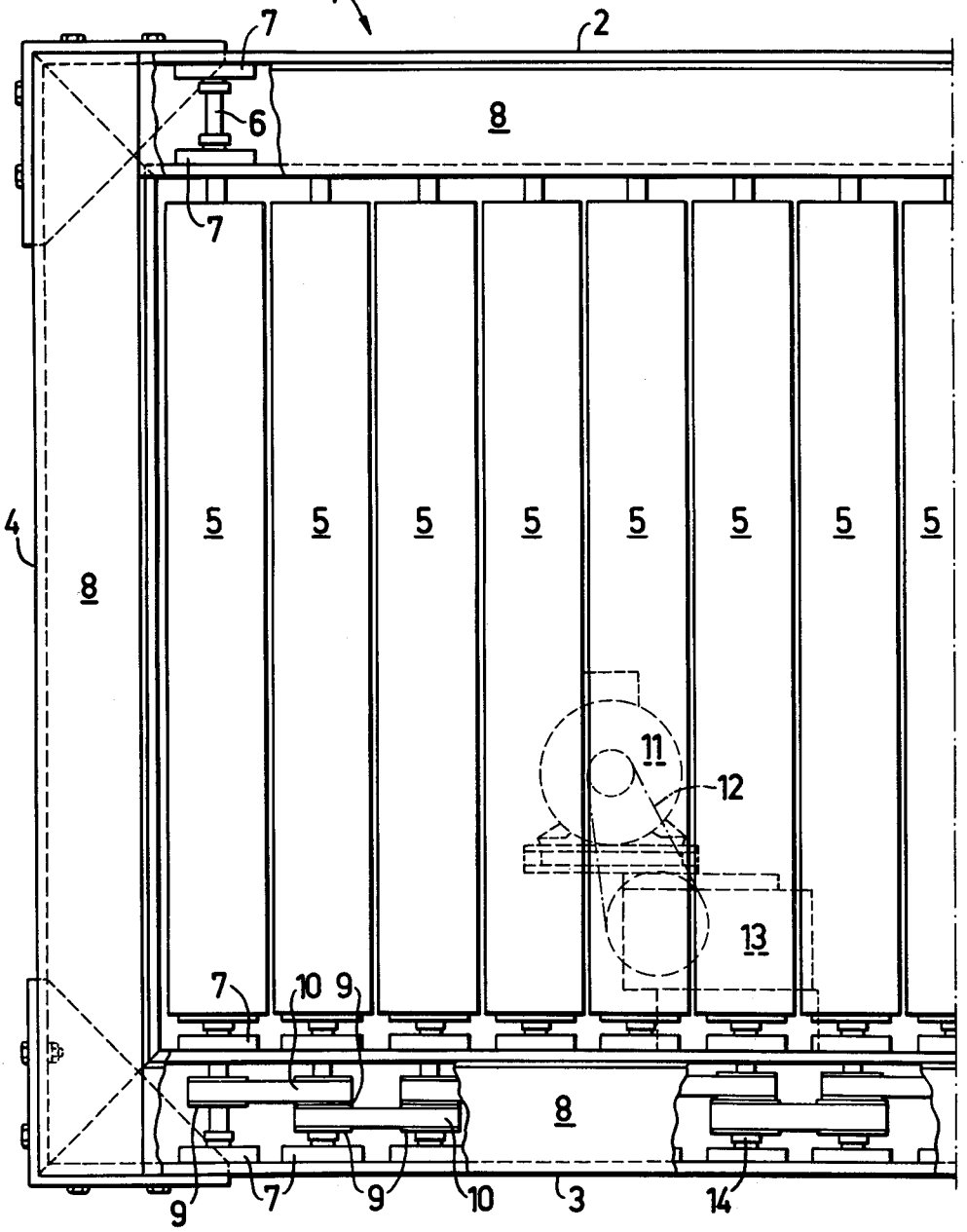
Figure 2:
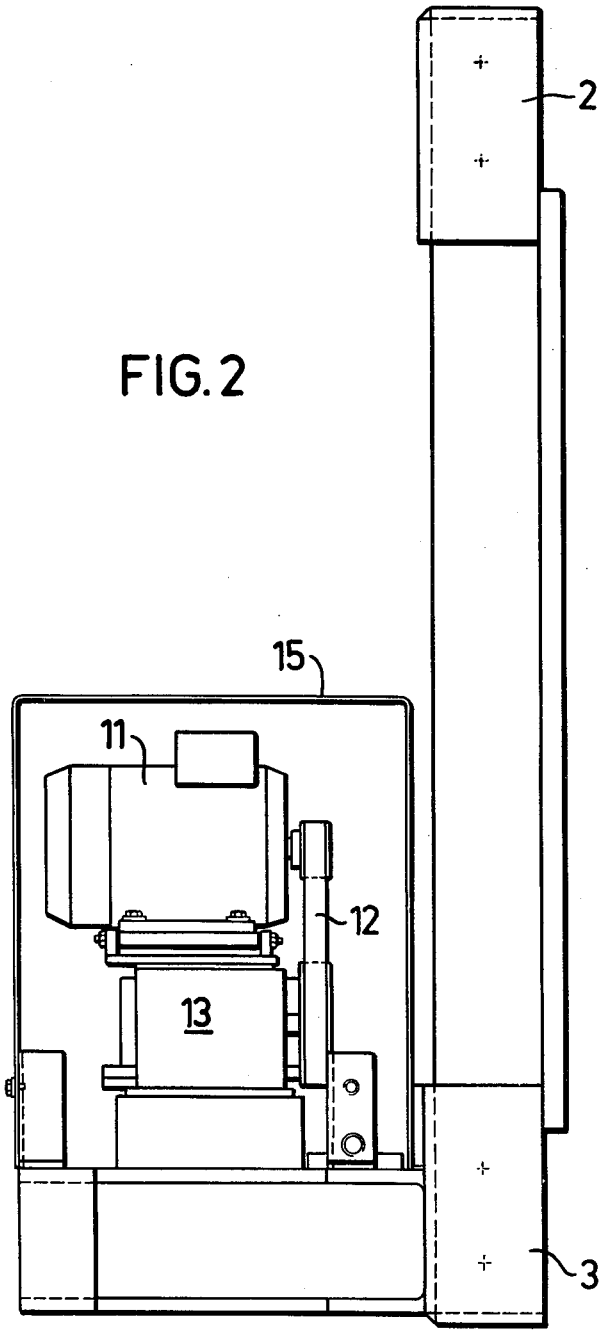

An embodiment of the invention is described in the following, with reference to the accompanying drawings, in which FIG. 1 shows a portion of a display arrangement according to the invention seen from its front side, and FIG. 2 shows the display arrangement seen from the side, making the drive motor apparent.

The display arrangement 1 comprises an upper frame beam 2, a lower frame beam 3 and vertical frame beams 4, of which latter only the left-hand one is shown. Between the upper frame beam 2 and the lower frame beam 3, prisms 5 are rotatably mounted. The prisms 5 are supported on rotary axles 6, and the prisms with the axles are so mounted and arranged between the frame beams 2 and 3, that the prisms easily can be removed and replaced by other prisms. The prisms 5, for example, are triangular aluminium sections and show simultaneously the same side forward in the plane of the display, so that the sides of all prisms together form the desired display picture. Thereafter the prisms are rotated through one third of a revolution, and simultaneously another side of the prisms is shown whereby another picture becomes apparent. The time during which the picture is shown depends on the rotation speed, or the rotation of the prisms may be intermittent so that the picture is shown a certain moment corresponding to the interval time between two rotations of the prisms. After the second picture has been shown, the prisms again are rotated through one third of a revolution, and a third picture is shown. The sequence is thereafter repeated. Triangular prisms, thus, can show three different pictures. The illumination of the prisms can be arranged in any known manner. The axles of rotation 6 for the prisms 5 are supported in flange bearings 7. The frame beams 2–4 are covered by cover plates 8, which for the sake of greater clearness are cut open in FIG. 1 in order to make the mounting and drive of the prism axles 6 apparent.

It appears from FIG. 1, that the rotation axles 6 are supported in the lower frame beam 3, and also that the drive transmission is positioned in the frame beam 3. At the embodiment shown each rotation axle 6 is with respect to drive coupled together with the adjacent rotation axle via a gear disc 9 and a toothed belt 10. Each rotation axle 6, thus, except the one farthest to the left and the one farthest to the right, carries two gear discs 9, and a toothed belt 10 runs about each gear disc.

The drive of the rotation of the prisms is effected by an electric motor 11, which drives via a belt transmission 12 a gear 13, which in its turn via a toothed belt (not shown) and a gear disc (not shown) drives one of the rotation axles of the prisms, for example the one designated by 14 in FIG. 1. When, thus, the rotation axle 14 is connected to the rotation axle to the right and to the left thereof, all rotation axles in series are driven via the gear 13. Said gear can be of any desired kind, for example such as an indexing gear which provides an intermittent motion of the outgoing shaft, implying that the drive is interrupted for a certain period of a length just adequate to show the sides of the prisms. Alternatively, the gear may be of a design providing a sufficiently slow motion of the prisms, so that a composed picture is conceivable when the prisms show their sides simultaneously.

FIG. 2 is a lateral view of the arrangement, showing that the drive motor 11 is located behind the display arrangement and drives the gear 13 via a toothed belt 12. The outgoing shaft (not shown) from the gear 13, as mentioned before, then drives one of the rotation axles 14 of the prisms. A cover 15 covers the drive motor 11, gear 13 and drive transmission.

Certain modifications can be imagined within the scope of the idea of the invention. As an example may be mentioned that instead of a plurality of toothed belts 10 only one belt can be applied which runs over all gear discs, which then are aligned and on each rotation axle 6 only one gear disc is provided. In such case a suitable means must be provided which ensures, that the toothed belt abuts the respective gear disc. The material of the toothed belt and gear discs can be chosen optionally.

What I claim is:

1. A display comprising:

a frame;

prisms rotatably mounted in said frame, each of said prisms including adjacent longitudinally extending side surfaces, each set of associated side surfaces of said prisms providing a display when rotated to a side by side position defining a permanently recurring sequence with the number of displays corresponding to the number of side surfaces on each prism;

each prism being provided with a first rotation axle at one end thereof and a second rotation axle at an opposite end thereof;

bearing means disposed on said frame for freely supporting said first and second axles of said prisms;

drive motor means and a transmission for rotating said prisms synchronously, said drive motor means being connected to one of said first rotation axles;

gear discs mounted on said first rotation axles of said prisms; and belt means mounted on said gear discs for rotating said gear discs and said prisms when said one of said first rotation axles is driven by said drive motor means, said belt means being toothed for meshing with said gear discs.

2. A display according to claim 1, wherein adjacent first rotation axles with respect to being driven are connected in pairs by said belt means, said belt means including a toothed belt for each pair.

3. A display according to claim 1, wherein at least two of said first rotation axles are driven by a common toothed belt defining said belt means.

4. A display according to claim 1, wherein said one of said first rotation axles and said drive motor means with respect to rotation are connected via an indexing gear.

* * * * *